US005259330A

United States Patent [19]

Faulkner

[11] Patent Number: 5,259,330

[45] Date of Patent: Nov. 9, 1993

[54] MOUNTING MEMBER FOR A PONTOON LOG AND METHOD OF ASSEMBLY

[75] Inventor: James Robert Faulkner, Lebanon, Mo.

[73] Assignee: Falcon Industries, Inc., Lebanon, Mo.

[21] Appl. No.: 794,070

[22] Filed: Nov. 19, 1991

[51] Int. Cl.[5] ..... B63B 3/04

[52] U.S. Cl. ..... 114/61

[58] Field of Search ..... 441/44-46; 114/56, 61, 85, 264, 266, 267, 283, 292, 356, 355, 361; 29/469

[56] References Cited

U.S. PATENT DOCUMENTS

| | | | |
|---|---|---|---|
| 2,975,747 | 3/1961 | Opie | 114/61 |
| 3,131,665 | 5/1964 | Kiekhaefer | 114/66.5 |
| 3,134,113 | 5/1964 | Boyington et al. | 9/6 |
| 3,673,976 | 7/1972 | Reynolds | 114/61 |
| 3,871,316 | 3/1975 | Woodrich | 114/61 |
| 4,227,898 | 10/1988 | Faulkner | 114/61 |
| 4,875,426 | 10/1989 | Soga et al. | 114/123 |
| 4,892,052 | 1/1990 | Zook et al. | 114/85 |
| 4,993,350 | 2/1991 | Pepper | 114/292 |

*Primary Examiner*—Mark T. Le
*Assistant Examiner*—Clifford T. Bartz
*Attorney, Agent, or Firm*—Senniger, Powers, Leavitt & Roedel

[57] ABSTRACT

A mounting member for use in a pontoon boat for mounting a boat structure onto a pontoon log flotation device comprising an elongated body having first and second protrusions extruded from the body and integral therewith. The first protrusion extends longitudinally of the body, and the second protrusion also extends longitudinally of the body generally parallel to the first protrusion. The first and second protrusions define a space therebetween for receiving an upper edge margin of the pontoon log, and are continuously sealed to the log along the lengths of the protrusions.

A method of assembling a pontoon log is also disclosed.

9 Claims, 3 Drawing Sheets 56
24
24
7

24
60
28
56
50
30
26

MOUNTING MEMBER FOR A PONTOON LOG AND METHOD OF ASSEMBLY

BACKGROUND OF THE INVENTION

This invention relates generally to flotation devices such as pontoon logs, and more particularly to a mounting member for a pontoon log for mounting on the log a structure to be supported by the log.

A common, although not exclusive, application of a pontoon log flotation device is in the construction of pontoon boats. A pontoon log generally includes an elongate hull which is U-shaped in cross section. Inside the hull is contained styrofoam or other flotation material which assists in providing buoyancy to the pontoon log. It is preferable that the log be completely sealed so that no water enters the log. In the past, this has been difficult to economically accomplish while at the same time providing for connection of the structure (e.g., the boat deck) supported by the log.

SUMMARY OF THE INVENTION

Among the several objects and features of the present invention may be noted the provision of a mounting member for a pontoon log which may be continuously and sealingly connected to the log along its entire length; the provision of such a mounting member which is one piece and preformed to fit onto the pontoon log; the provision of such a mounting member which supports a cap plate for sealing the open top of the log; the provision of such a mounting member on which structure may be mounted; and the provision of such a mounting member which is easy to use and relatively economical to manufacture.

Further among the several objects and features of the present invention may be noted the provision of a method for assembling a water-tight pontoon log; the provision of such a method in which attachment of a mounting member for supporting structure facilitates sealing the log; and the provision of such a method which can be carried out quickly and economically.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
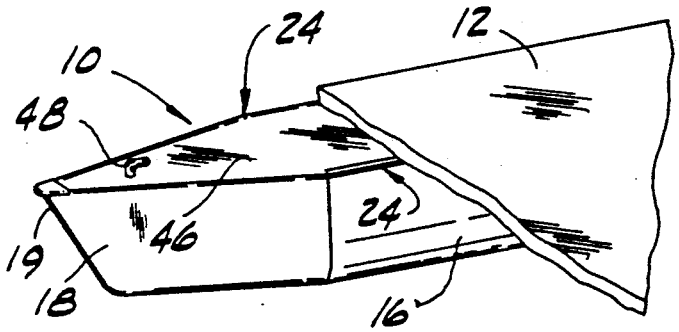
FIG. 1 is a perspective view of a pontoon boat with parts broken away to show a pontoon log and the mounting member of the present invention.

Referring now to the drawings and in particular to FIG. 1, a pontoon boat including pontoon logs 10 (one of which is shown) for flotation devices. The boat includes a deck panel 12 supported on stringers 14 extending generally transversely of the deck panel, which are mounted on the log 10. The pontoon log 10 includes a hull 16 made from an elongate piece of sheet metal, such as aluminum, which is formed into a shape which is concave in cross section, having an open top and open ends. A tapered nose 18 is connected such as by welding to the forward end of the hull 16 to facilitate flow of water around the log 10. The nose 18 is also formed from a piece of sheet metal which is cut with a V-shaped notch in one side so that when the sheet metal piece is formed into its U-shape, the inner edges of the V-shaped cut are brought together and secured such as by welding along a seam 19. The open rear end of the hull 16 is closed by a U-shaped, transversely extending, transom member 20 sized to fit in the open rear end of the hull. The transom member 20 is sealingly secured to the hull 16 in a suitable fashion such as by welding. In the preferred embodiment, the hull 16 is approximately 19' 10½" long, 21½" wide and 2' deep. However, it is to be understood that the hull 16 may have other dimensions and still fall within the scope of the present invention.

Figure 2:
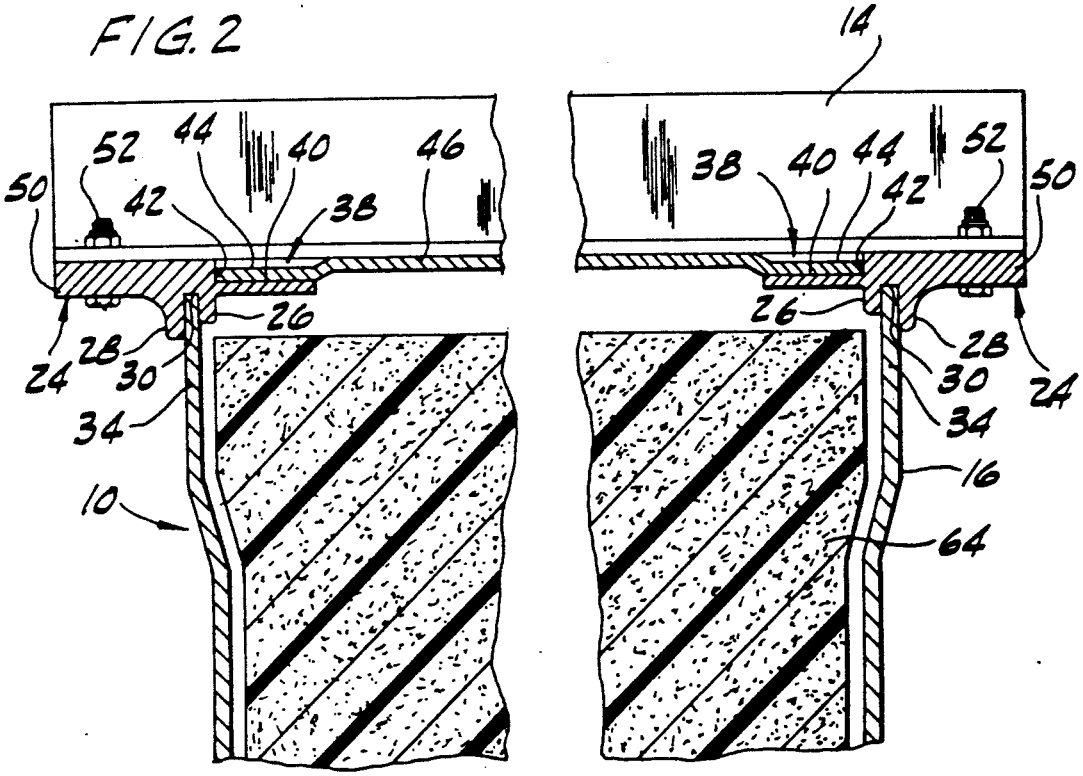
FIG. 2 is a cross section of a pontoon log.
Figure 3:
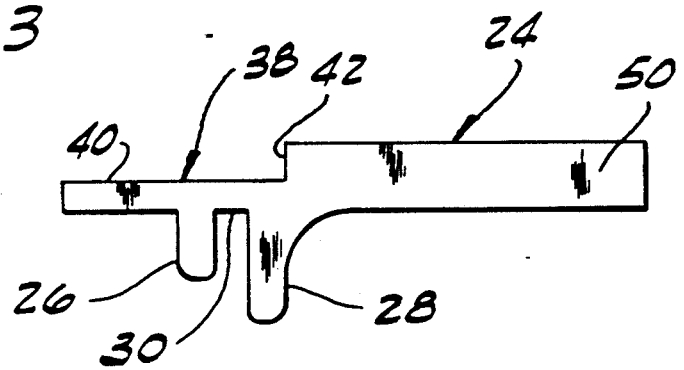
FIG. 3 is an end elevation of the mounting member.
Figure 4:
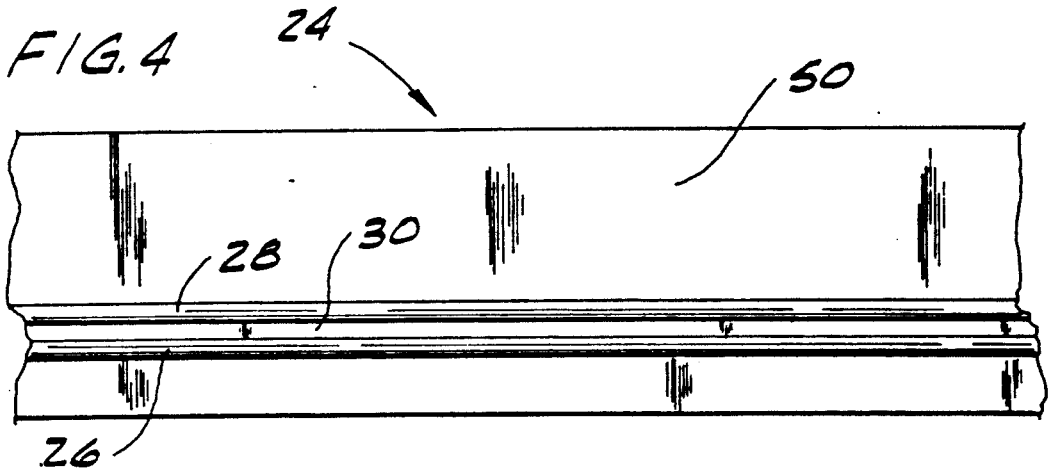
FIG. 4 is a fragmentary bottom plan of the mounting member.

As shown in FIG. 2, a mounting member, generally indicated at 24, is connected to the hull 16 so that the structure (e.g., stringers 14 and deck panels 12) may be mounted on the pontoon log 10. The mounting member 24 is an elongated body having a length generally corresponding to the length of the hull 16, and is made of a suitable material such as aluminum. The mounting member 24 includes a first, or inside protrusion 26 formed by extrusion from the mounting member, and a second, or outside protrusion 28 formed by extrusion from the mounting member. The inside protrusion 26 extends the length of the mounting member 24, and the outside protrusion 28 also extends the length of the mounting member generally parallel to the inside extrusion. As shown in FIG. 3, the protrusions 26, 28 are spaced so that they define a channel 30 between them. An upper longitudinal edge margin 34 of the hull 16 adjacent its open top and along one side may be received in the channel 30 for connecting the mounting member 24 to the hull 16. The protrusions 26, 28 are sealingly secured to the hull 16 along their entire length by welding. Similarly, a second mounting member 24 is secured to an opposite upper longitudinal edge margin 34 of the hull 16. Shorter mounting members 24 are mounted on the upper edge margins of the nose 18 and the transversely extending transom member 20, and the joints between adjacent mounting members are welded to form a mounting member which extends continuously around the upper edge of the hull 16.

The upper inside edge margin of the mounting member 24 is formed with a recess 38, having a bottom wall 40 and a back wall 42, in which the edge margins 44 of a cap plate 46 may be received and held. The edge margins 44 of the cap plate 46 lie in close proximity to the back wall 42 of the recess 38, allowing the cap plate to be readily sealed by welding at the peripheral edge margins to the mounting member 24. The cap plate 46 has approximately the same length and lateral dimension as the open top of the hull 16 and nose 18 so that the open top is closed by the cap plate. The pontoon log 10 is sealed with the welding of the cap plate 46 to the mounting members 24 around the entire upper edge 34 of the hull 16, nose 18 and transom member 20. A tube 48 is mounted over an opening (not shown) in the cap plate 46 to allow the interior of the log 10 to breath.

Figure 5:
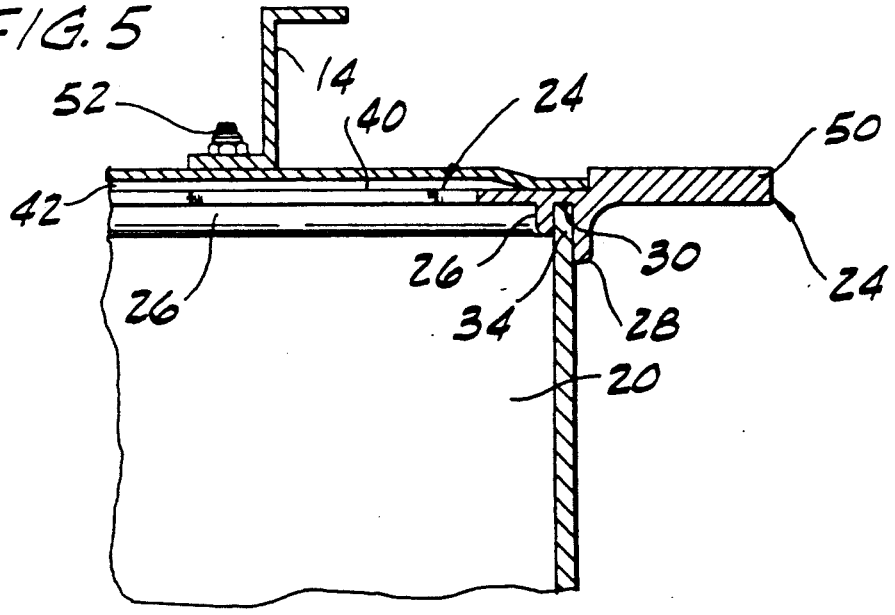
FIG. 5 is a fragmentary cross section of the pontoon log adjacent the rear end thereof, shown with a cap plate removed.

A mounting ledge 50 of the mounting member 24 projects laterally outwardly from the hull 16 for mounting structure of the boat above the pontoon log 10. The stringers 14 have a Z-shaped cross section and extend laterally across at least two pontoon logs 10 of the aforementioned construction. The stringers 14 are attached to the mounting ledge 50 by suitable fasteners such as bolts 52, as shown in FIGS. 2 and 5. The stringers 14 support the deck panels 12 of the boat and the other structure erected on the deck panels.

Figures 6, 7:
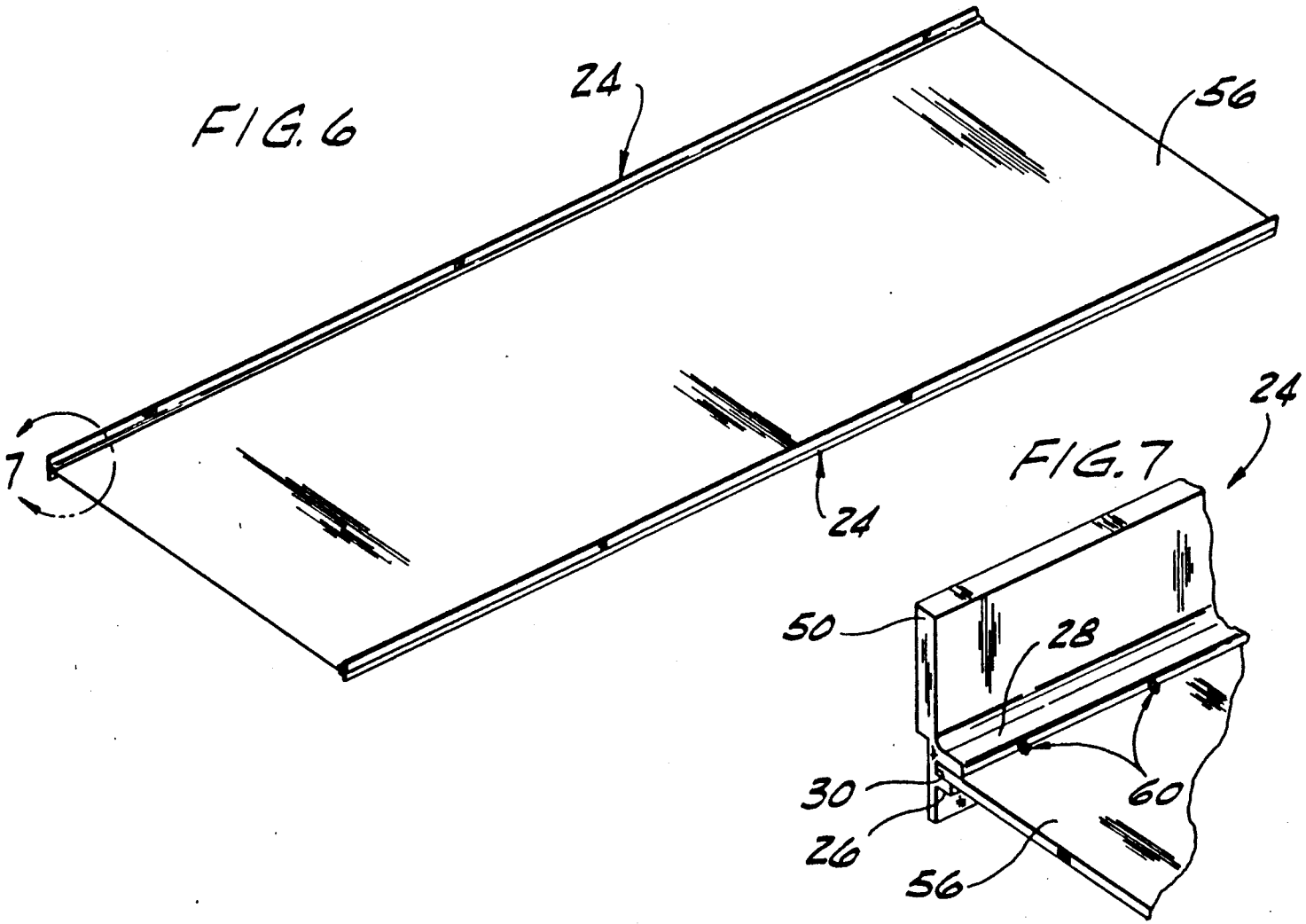
FIG. 6 is a sheet of material for forming a log having the structural members attached thereto.
FIG. 7 is an enlarged fragmentary perspective showing the attachment of the mounting member.

Referring now to FIG. 6, a pontoon log 10 of the present invention is constructed from an elongate rectangular piece 56 of aluminum sheet metal for the hull, and a smaller piece of sheet metal (not shown) for the nose 18. A mounting member 24 having a length substantially equal to the length of the rectangular piece 56 is fitted onto one of the longitudinally extending edges of the piece with the edge margin being received in the channel 30 defined by the separation of the extruded protrusions 26, 28 of the mounting member. The space between the protrusions 26, 28 is generally such that the mounting member 24 snaps onto the edge of the sheet metal piece 56 and is temporarily held on the piece. Another, substantially identical mounting member 24 is fitted onto the opposite longitudinal edge. As may be seen in FIG. 7, the mounting member 24 is initially spot welded at locations 60 along its length.

The metal sheet piece 56 is then folded into a generally U shape over a die (not shown) to form the hull 16. At this point, the pontoon log 10 is inverted from its final position. The outer protrusions 28 of the mounting members 24 are welded to the hull 16 along its entire length. The piece of sheet metal for the nose 18 is formed with inwardly tapered edge margins and a larger V-shaped notch generally in the middle of the forward edge margin. The nose 18 is formed by folding it over a die (not shown) and bringing together the opposing edges of the V-shaped notch a securing them such as by welding to form the seam 19. Shorter mounting members 24 are then fitted onto the upper edge margins of the nose 18. These mounting members 24 are specially cut so that they fit together at the tip of the nose 18, and also fit with the transverse edges of the mounting members adjacent the nose. The outer protrusions 28 of the shorter nose mounting members 24 are secured by welding to the log.

The hull 16 is then taken off the die and inverted to its final position. The inner protrusion 26 is welded to the inside of the hull 16. The U-shaped transom member 20 is welded in the open rear end of the hull 16 to close that end, and a short transverse mounting member 24 is fitted onto the upper edge of the transom and secured by welding its inner and outer protrusions 26, 28 to the transom. The nose 18 is taken off the die and inverted to its final position. The seam 19 is welded on the interior of the nose, and the inner protrusions 26 of the shorter mounting members 24 are also welded to the nose. The nose is attached to the hull 16 by welding rear portions of the nose on the inside of the hull. After all of the mounting members 24 have been fitted onto the log 10 and secured by welding, there is a continuous strip of welding around the upper peripheral edge of the log forming a continuous seal between the mounting members and the log.

Flotation material such as styrofoam 64 is then placed into the hull 16, and the cap plate 46 is set over the open top of the hull with the peripheral edge margins 44 of the cap plate being received in the recesses 38 in the mounting members. The styrofoam 64 maintains the buoyancy of the log 10 should it be punctured and fill with water. The peripheral edge margins 44 of the cap plate are welded to the mounting members 24 generally at the back wall 42 of the recess 38 to make the pontoon log water-tight. The structure of the boat may then be built on the log. Typically, this includes at least bolting the stringers 14 onto the mounting ledges 50 of the mounting members 24, and attaching the deck panels 12 to the stringers.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A pontoon log used for flotation, the log comprising:

an elongated hull generally concave in cross section, the hull having an open top and opposing upper edge margins adjacent the top and extending the length of the hull;

elongated mounting members each comprising a first protrusion extending longitudinally thereof, and a second protrusion extending longitudinally thereof generally parallel to the first protrusion, the protrusions defining a channel therebetween adapted to receive one of the upper edge margins of the hull therein, at least one of the protrusions being continuously sealingly attached along its length to the hull, the mounting member including means for mounting structure thereon, said mounting means extending laterally away from the upper edge margin received between the first and second protrusions; and a recessed portion formed therein, the recessed portion being separate from the channel defined by the first and second protrusions and adapted to receive a peripheral edge portion of a generally flat, rectangular cap plate and to be sealingly connected to the cap plate.

2. A pontoon log as set forth in claim 1, said cap plate further comprising a structure having approximately the same length and lateral dimension as the hull for closing the open top of the hull, each mounting member having means for receiving a peripheral edge portion of the cap plate.

3. A pontoon log as set forth in claim 1 wherein the hull comprises at least one transversely extending portion having an upper edge margin, and wherein the pontoon log further comprises a transverse mounting member, a first protrusion extruded from the mounting member and extending longitudinally thereof, and a second protrusion extruded from the mounting member and extending longitudinally thereof generally parallel to the first protrusion, the protrusions of the transverse mounting member defining a channel therebetween adapted to receive the upper edge margin of the transverse portion of the hull.

4. A pontoon log as set forth in claim 1 wherein each mounting member is attached to the hull by continuously welding the first and second protrusions along their entire lengths to the hull.

5. A pontoon log as set forth in claim 1 further comprising flotation material inside the hull and said cap plate having approximately the same length and lateral dimension as the hull for closing the open top of the hull, each mounting member having means for receiving a peripheral edge portion of the cap plate, the edge portion of the cap plate being sealingly connected to the mounting member in said receiving means such that the flotation material is sealed within the hull.

6. A mounting member for use in a pontoon boat for mounting a boat structure onto a pontoon log flotation device, the mounting member comprising:

an elongated body;

a first protrusion integral with the body, the first protrusion extending longitudinally of the body;

a second protrusion integral with the body, the second protrusion extending longitudinally of the body generally parallel to the first protrusion;

the first and second protrusions defining a space therebetween adapted to receive an upper edge margin of the pontoon log, and being adapted for continuous, sealing connection to the log along the lengths of the protrusions;

means for mounting the boat structure comprising a ledge portion constructed and arranged relative to the first and second protrusions such that the ledge portion extends laterally away from the upper edge margin received between the first and second protrusions when the mounting member is attached to the pontoon log; and a recessed portion formed in the mounting member, the recessed portion being separate and apart from the space defined by the first and second protrusions and adapted to receive a peripheral edge portion of a generally flat, rectangular cap plate and to be sealingly connected to the cap plate.

7. A method of constructing a pontoon log of the type used for flotation, the method comprising the steps of:

providing mounting members each having a body and a first protrusion extending longitudinally of the body, and a second protrusion extending longitudinally of the body and generally parallel to the first protrusion, the protrusions defining a channel therebetween;

providing a generally rectangular sheet of material for forming the pontoon log, the sheet having opposing longitudinal edges and opposing longitudinal edge margins;

fitting the mounting member onto a longitudinal edge of the sheet of material with one of the longitudinal edge margins being received in the channel between the protrusions;

fitting another mounting member onto an opposite longitudinal edge of the sheet of material with the opposite longitudinal edge margin being received in the channel between the protrusions;

forming the sheet of material into a generally concave shape;

securing the mounting member continuously along one of its protrusions to the sheet;

securing the other mounting member continuously along one of its protrusions to the sheet.

8. A method as set forth in claim 7 further comprising the step of placing flotation material in the pontoon log.

9. A method as set forth in claim 8 wherein the mounting members have means for receiving and holding a peripheral edge portion of a cap plate therein, and wherein the method further comprises setting the cap plate over the open top of the log with the edge margins of the cap plate being received in said receiving means of the mounting members, and attaching the cap plate continuously along its length to the mounting members.

* * * * *